US005303997A

United States Patent [19]

Kropf

[11] Patent Number: 5,303,997

[45] Date of Patent: Apr. 19, 1994

[54] SLIDABLE AND VERTICALLY ADJUSTABLE REFRIGERATOR/FREEZER BASKET AND MOUNTING ARRANGEMENT THEREFOR

[75] Inventor: Keith E. Kropf, Newton, Iowa

[73] Assignee: Maytag Corporation, Newton, Iowa

[21] Appl. No.: 956,959

[22] Filed: Oct. 6, 1992

[51] Int. Cl.[5] ..... F47B 88/00

[52] U.S. Cl. ..... 312/334.4; 312/410

[58] Field of Search ..... 312/410, 334.4, 334.44, 312/330.1

[56] References Cited

U.S. PATENT DOCUMENTS 5,211,461 5/1993 Teufel et al. ..... 312/334.4

*Primary Examiner*—Kenneth J. Dorner
*Assistant Examiner*—Gerald A. Anderson
*Attorney, Agent, or Firm*—Bacon & Thomas

[57] ABSTRACT

A basket and mounting arrangement for use in a refrigerator/freezer storage compartment is disclosed. The basket is provided with a plurality of generally longitudinally extending support rails which are carried on each side of the basket and which are adapted to be slidably received in a pair of guide members secured to opposing sidewalls of the storage compartment. In one embodiment, the plurality of support rails comprise a first pair which are located on opposite sides of the basket in a substantially horizontal first plane and a second pair of support rails which are located on opposite sides of the basket and are vertically spaced a predetermined distance from the first pair of support rails in a substantially horizontal second plane. Either pair of support rails can be readily engaged with the pair of guide members to alter the vertical position of the basket. The basket is constructed in a manner such that the support rails are laterally spaced a predetermined distance from the sidewalls of the basket in order to prevent interference with the movement of the basket by goods stored therein. The guide members are integrally formed with upstanding abutment flanges which engage stop members carried by the support rails to limit sliding movement of the basket.

20 Claims, 10 Drawing Sheets

5
105
115
125
165
175
185
195
250
255
260
285
295
305

SLIDABLE AND VERTICALLY ADJUSTABLE REFRIGERATOR/FREEZER BASKET AND MOUNTING ARRANGEMENT THEREFOR

BACKGROUND OF THE INVENTION

1. Field of the Invention

The present invention pertains to a basket and mounting arrangement for use in a refrigerator/freezer storage compartment. More specifically, the invention is directed to an improved basket arrangement for use in storing goods in a refrigerator/freezer storage compartment and a mounting assembly for slidably and vertically adjustably supporting the basket within the storage compartment in a manner which maximizes the storage capacity of the basket while assuring that any goods stored in the basket will not interfere with the selective movement of the basket.

2. Description of the Prior Art

Slidably mounted refrigerator/freezer storage compartment baskets are known in the art. Such known arrangements are generally mounted within the storage compartment upon a pair of guide rails such that the bottom of the basket simply rests atop the rails. Unfortunately, these known slidably basket mounting assemblies do not provide for readily and vertically adjusting the position of the baskets within the storage compartment.

It is further known in the art to slidably mount a basket to a pair of spaced guide rails secured within a storage compartment by utilizing a plurality of rollers which are attached to the basket and engage the guide rails. Although this type of arrangement provides for smooth operation of the basket into and out of the storage compartment, such a mounting arrangement requires rather precise tolerances in order to assure the smooth operation of the mounting assembly and also significantly adds to its cost. In addition, unless auxiliary rollers or guide rails are utilized, these known arrangements also do not provide for vertically adjusting the position of the basket within the storage compartment.

Finally, it is also known in the art to provide baskets with longitudinally extending flanges that project outwardly along a top edge of the basket's sides which can be used in combination with a pair of guide rails mounted in the storage compartment to enable the basket to be slidably mounted therein. In these arrangements, it is often found that goods stored in the basket interfere with the smooth operation of the slidable mounting assembly, especially when wire baskets are utilized.

Therefore, there exists a need in the art for a basket and mounting arrangement for use in the refrigerator/-freezer storage compartment which will enable the basket to be readily slidable and vertically adjustable within the compartment in a cost-effective manner while assuring that any goods stored in the basket will not interfere with the movement of the basket.

SUMMARY OF THE INVENTION

It is an object of the present invention to provide an improved basket and mounting arrangement for use in a refrigerator/freezer storage compartment which enables the basket to be readily and vertically adjusted within the storage compartment.

It is another object of the present invention to provide a mounting assembly for a refrigerator/freezer storage compartment basket wherein the basket is slidably mounted within the storage compartment and is configured so as to minimize any potential interference with the movement of the basket by goods stored in the basket.

These and other objects of the present invention are accomplished by providing a plurality of generally longitudinally extending support rails which are carried on each side of the basket and which are adapted to be slidably received in a pair of guide members secured to opposing sidewalls of the storage compartment. The plurality of support rails comprise a first pair of support rails which are located on opposite sides of the basket in a first substantially horizontal plane and a second pair of support rails which are located on opposite sides of the basket and are vertically spaced a predetermined distance from the first pair of support rails in a second substantially horizontal plane. Either pair of support rails can be readily and selectively engaged with the pair of guide members to alter the vertical position of the basket. The basket is constructed in a manner such that the support rails are laterally spaced a predetermined distance from the sidewalls of the basket in order to minimize potential interference with the movement of the basket relative to the guide members by goods stored in the basket.

Other objects, features and advantages of the present invention shall become apparent from the following detailed description of preferred embodiments thereof, when taken in conjunction with the drawings wherein like reference numerals refer to corresponding parts in the several views.

DETAILED DESCRIPTION OF THE PREFERRED EMBODIMENTS

Figure 1:
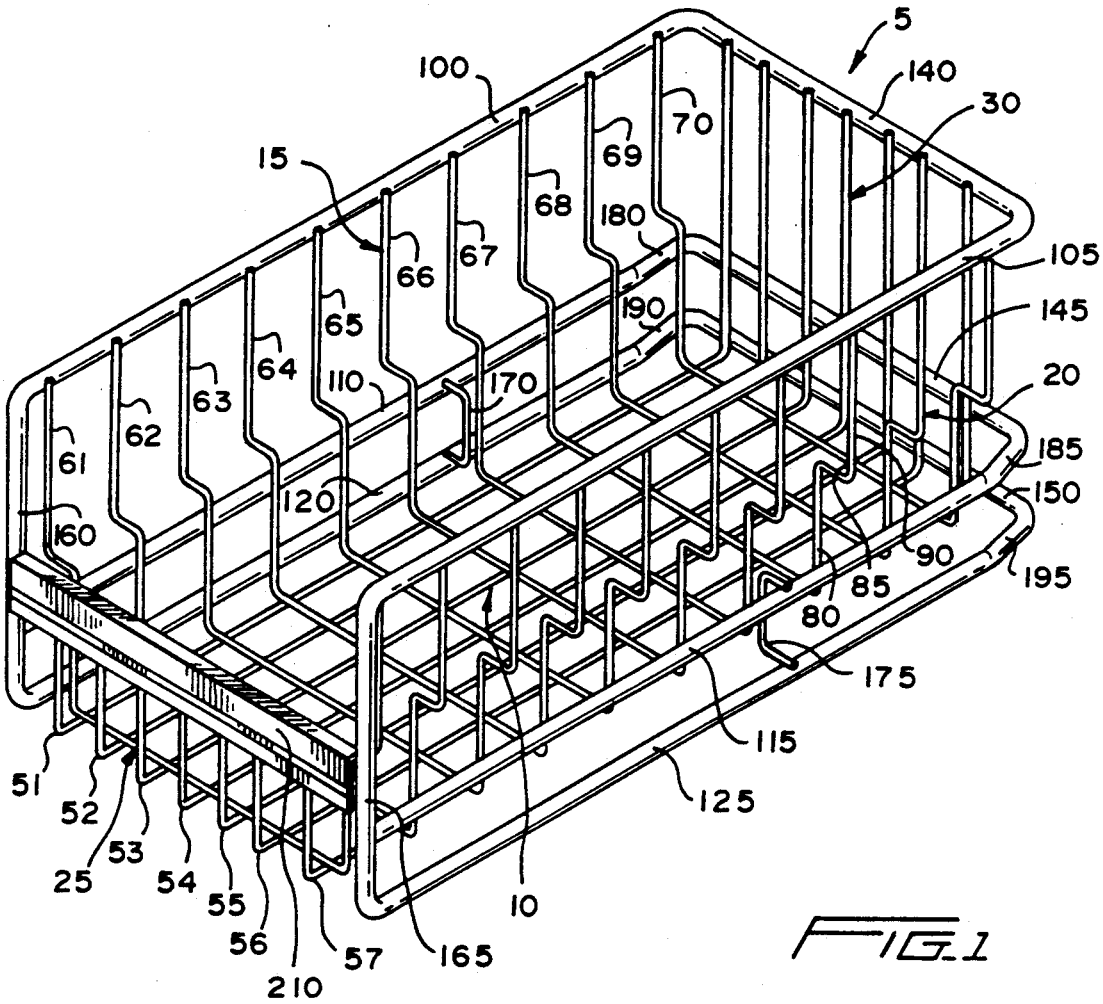
FIG. 1 is a perspective view of a basket and support assembly according to a first embodiment of the invention.
Figure 2:
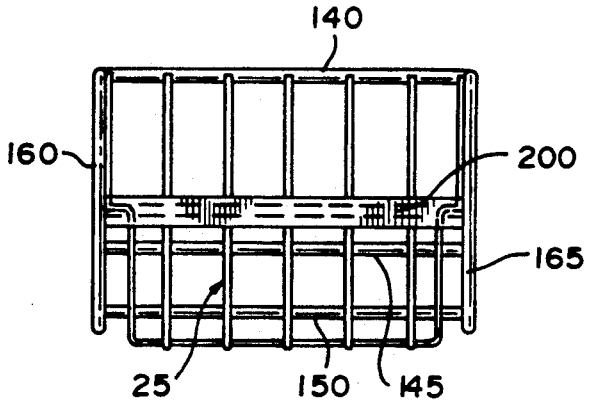
FIG. 2 is a front view of the basket depicted in FIG. 1.
Figure 4:
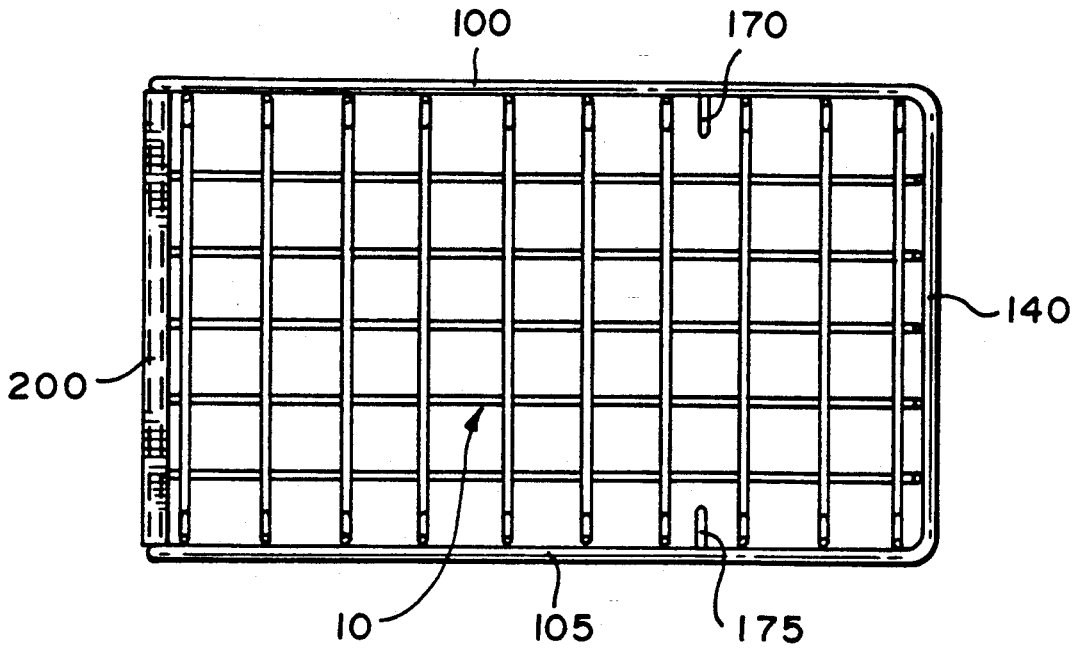
FIG. 4 is a top view of the basket depicted in FIG. 1.

Initially, reference is made to FIGS. 1-4 in describing a basket assembly, generally indicated at 5, according to a first embodiment of the invention. Basket assembly 5 comprises a basket having a bottom wall portion 10, a pair of laterally spaced, opposing sidewall portions 15, 20, a front wall portion 25 and a rear wall portion 30. In the embodiment shown, the side, front and rear wall portions 15, 20, 25 and 30 respectively extend substantially upright from about the periphery of bottom wall portion 10 so as to define a basket storage area above bottom wall portion 10. Front and rear wall portions 25, 30 are defined by a plurality of laterally spaced rail members 51-57 which extend from front wall portion 25, longitudinally across bottom wall portion 10, to rear wall portion 30. In a similar manner, sidewall portions 15, 30 are defined by a plurality of longitudinally spaced rail members 61-70 that extend from sidewall portion 15, laterally across bottom wall portion 10, to sidewall portion 20. By this arrangement, longitudinally spaced rail members 61-70 criss-cross with laterally spaced rail members 51-57 so as to define bottom portion 10. This arrangement provides added structural stability of bottom portion 10 in order to increase its load capacity while minimizing the size of the rail members.

As clearly shown in FIGS. 1-4, front wall portion 25 projects upward above bottom wall portion 10 a distance which is less than the distance in which sidewall portions 15, 20 and rear wall portion 30 extend above bottom wall portion 10. This enables the basket storage area to be more readily accessible by a user. Furthermore, from viewing these figures, it can be seen that although sidewall portions 15 and 20 extend substantially upright from bottom wall portion 10, each of the longitudinally spaced rail members 61-70 includes a lower section 80 that extends upwardly from bottom wall portion 10 for a first predetermined distance, a central section 85 that extends laterally outwardly from lower section 80 for a second predetermined distance and an upper section 90 that extends upwardly from central section 85 a third predetermined distance. In the preferred embodiment, laterally spaced rail members 51-57 and longitudinally spaced rail members 61-70 constitute metal rods or wires to which a plastic or enamel coating is applied. In addition, the rail members are welded together at their cross junctions in bottom wall portion 10.

Basket assembly 5 further includes a plurality of support rails which function to interconnect laterally spaced rail members 51-57 and longitudinally spaced rail members 61-70 to provide additional support and to enable basket assembly 5 to be slidably and vertically adjustable mounted within a storage compartment. The embodiment shown in FIGS. 1-4 includes a pair of laterally spaced upper support rails 100, 105 to which the top ends of longitudinally spaced rail members 61-70 are attached, and first and second pairs of lower support rails 110, 115 and 120, 125. Each pair of support rails 110, 115 and 120, 125 are located on opposite sides of basket assembly 5 with the first pair of support rails, 110, 115 being located in a first substantially horizontal plane and the second pair of support rails 120, 125 being vertically spaced a predetermined distance from the first pair of support rails 110, 115 in a second substantially horizontal plane. Either the first pair of support rails 110, 115 or the second pair of support rails 120, 125 can be used to slidably mount basket assembly 5 upon a pair of the guide members to enable basket assembly 5 to be selectively located in one of plural vertical positions.

In the preferred embodiment, support rails 100, 105, 110, 115, 120 and 125 are interconnected to define a unitary construction. Therefore, support rails 100 and 105 are interconnected at rear wall portion 30 by means of an upper connecting rail 140 and the lower support rail pairs 110, 115 and 120, 125 are interconnected by a pair of lower rear connecting rails 145 and 150 respectively. In addition, support rails 100, 110 and 120 are interconnected adjacent the corner of sidewall portion 15 and front wall portion 25 by a vertically extending connecting rail 160. In a similar manner, support rails 105, 115 and 125 are interconnected by a vertically extending connecting rail 165. In actuality, support rails 100, 105, 120 and 125, along with connecting rails 140, 150, 160 and 165, are formed from a single metal rod which is bent to form the individual rail members. Support rails 110 and 115, along with connecting rail 145, are also formed from a single metal rod bent to form the individual rail members and welded to vertical connecting rails 160 and 165 at front end portions of support rails 110 and 115 respectively. In addition, a pair of U-shaped stop members 170, 175 are welded between opposed upper surface portions of support rails 110, 120 and 115, 125, respectively. Stop members 170 and 175 not only function to provide additional structural rigidity to basket assembly 5, but are also strategically located along the longitudinal length of rail members 110, 115, 120 and 125 to limit the degree in which basket assembly 5 can be extended out of a storage compartment.

Figure 3:
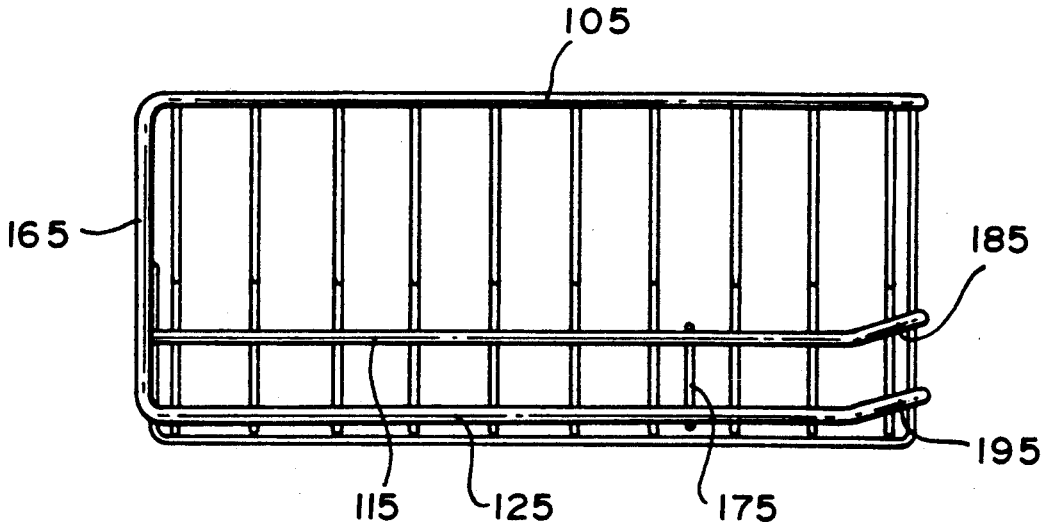
FIG. 3 is a side view of the basket depicted in FIG. 1.

As best shown in FIGS. 1 and 3, support rails 110, 115, 120 and 125 include two pairs of rear sections 180, 185 and 190, 195, respectively, which slope upwardly with respect to the general horizontal plane defined by the support rail pairs such that lower rear connecting rails 145 and 150 are located vertically above support rail pairs 110, 115 and 120, 125 respectively. The purpose of providing sloping rear sections 180, 185, 190 and 195 will be later described with reference to FIGS. 9-11. Finally, an additional rail member 200, as shown in phantom in FIGS. 2 and 4, extends between vertical connecting rails 160 and 165 to define the top of front wall portion 25 and a protective cover member 210, which is generally U-shaped in cross-section, extends over additional support rail 200 and the upper end portions of laterally spaced rail members 51–57 to protect a user when accessing the basket storage area.

Reference will now be made to FIGS. 5–8 in describing a preferred guide member construction for use in mounting the baskets encompassed by the present invention within a refrigerator/freezer storage area. The guide member is generally indicated at 250 in FIG. 5 and is preferably formed from molded plastic or other light-weight material. Guide member 250 is also preferably symmetrically formed such that the second longitudinal half of guide member 250 is a mirror image of the first longitudinal half. In this manner, only a single type of guide member needs to be manufactured and can be used as a guide member on either side of the opposing sidewalls of the storage compartment. In general, guide member 250 includes a longitudinally extending top wall 255, a longitudinally extending base wall 260 and a sidewall 265 which interconnects top wall 255 with base wall 260. Therefore, guide member 250 is generally U-shaped in cross-section to define an open channel.

Figure 5:
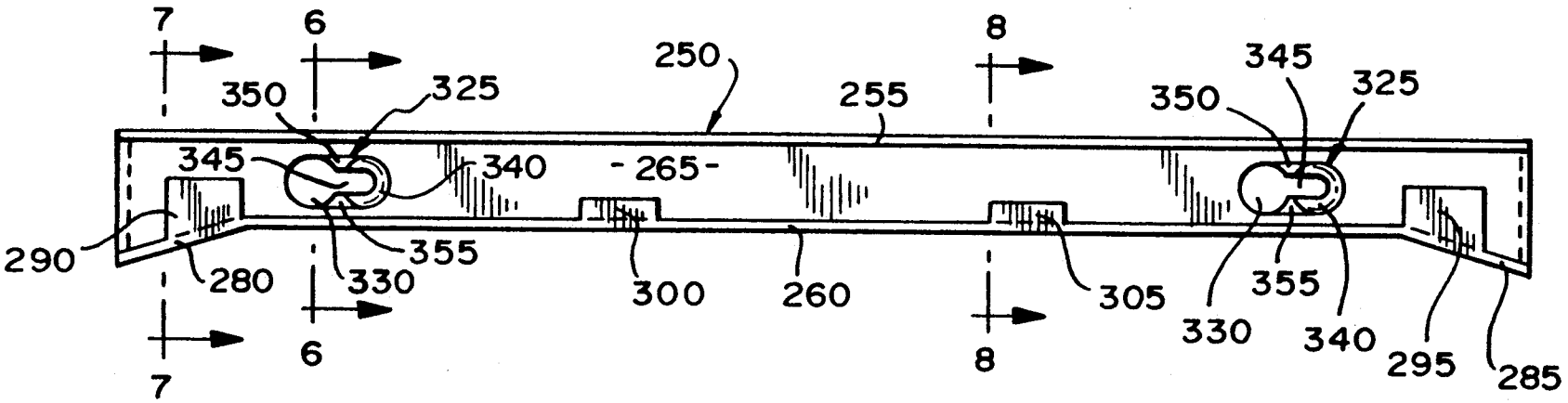
FIG. 5 is a side view of a guide member used in mounting the baskets of the present invention within a storage compartment.
Figure 8:
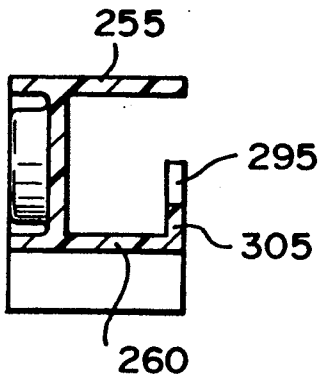
FIG. 8 is a cross-sectional view taken along line 8—8 in FIG. 5.
Figure 7:
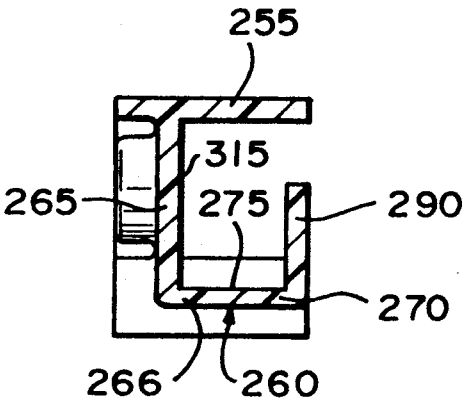
FIG. 7 is a cross-sectional view taken along line 7—7 in FIG. 5.
Figure 6:
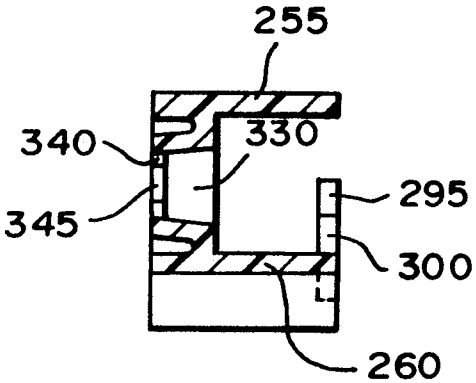
FIG. 6 is a cross-sectional view taken along line 6—6 in FIG. 5.

In cross-section, base wall 260 includes first and second end portions 266 and 270 along with an upper surface portion 275. Base wall 260 also includes longitudinal end portions 280 and 285 which slope downwardly as viewed in FIG. 5. Ends 270 of downwardly sloping portions 280 and 285 are each formed with an upwardly extending abutment flange 290, 295 respectively which are used in combination with stop members 170 and 175 on basket assembly 5 to limit the sliding movement of basket assembly 5 out of a storage area as will be described more fully below. Located inwardly from abutment flanges 290, 295 is a pair of longitudinally spaced guide tabs 300, 305 which extend from end portion 270 of base 260 toward top wall 255, as best shown in FIGS. 5, 6 and 8. Guide tabs 300 and 305 function to laterally locate a respective one of the support rails 110, 115, 120 and 125 within the channel defined by guide member 250 when the support rails are engaged with upper surface 275 of base wall 260.

FIGS. 5 and 6 depict the manner in which guide member 250 is adapted to be mounted to a sidewall of a storage compartment. For this purpose, guide member 250 includes two longitudinally spaced aperture arrangements, one of which will now be described in detail. An inner surface 315 of sidewall 265 is formed with a recessed slot, generally indicated at 325. A first side portion of slot 325 includes a uniform diameter aperture 330 and a second side portion of slot 325 is further recessed within sidewall 265 and terminates in a base portion 340. A through slot 345 extends from aperture 330 toward the second side portion of slot 325. Aperture 330 is separated from base portion 340 along opposing outer edges of slot 325 by a pair of radial projections 350, 355. By this arrangement, a screw or other fastener (not shown) that extends outwardly from a sidewall of a storage compartment may have a head that extends through aperture 330 and a reduced diameter threaded shaft portion which is smaller in diameter than the size of through slot 345, such that when the screw head is inserted in aperture 330 beyond radial projections 350 and 355, the guide member 250 may be shifted such that the screw head will then be located over base portion 340. At this time, the screw can be tightened onto base portion 340 and will maintain the position of guide member 250 within a storage compartment since the head of the screw will be trapped between sidewall 265 and radial projections 350 and 355.

Figures 9, 10, 11:
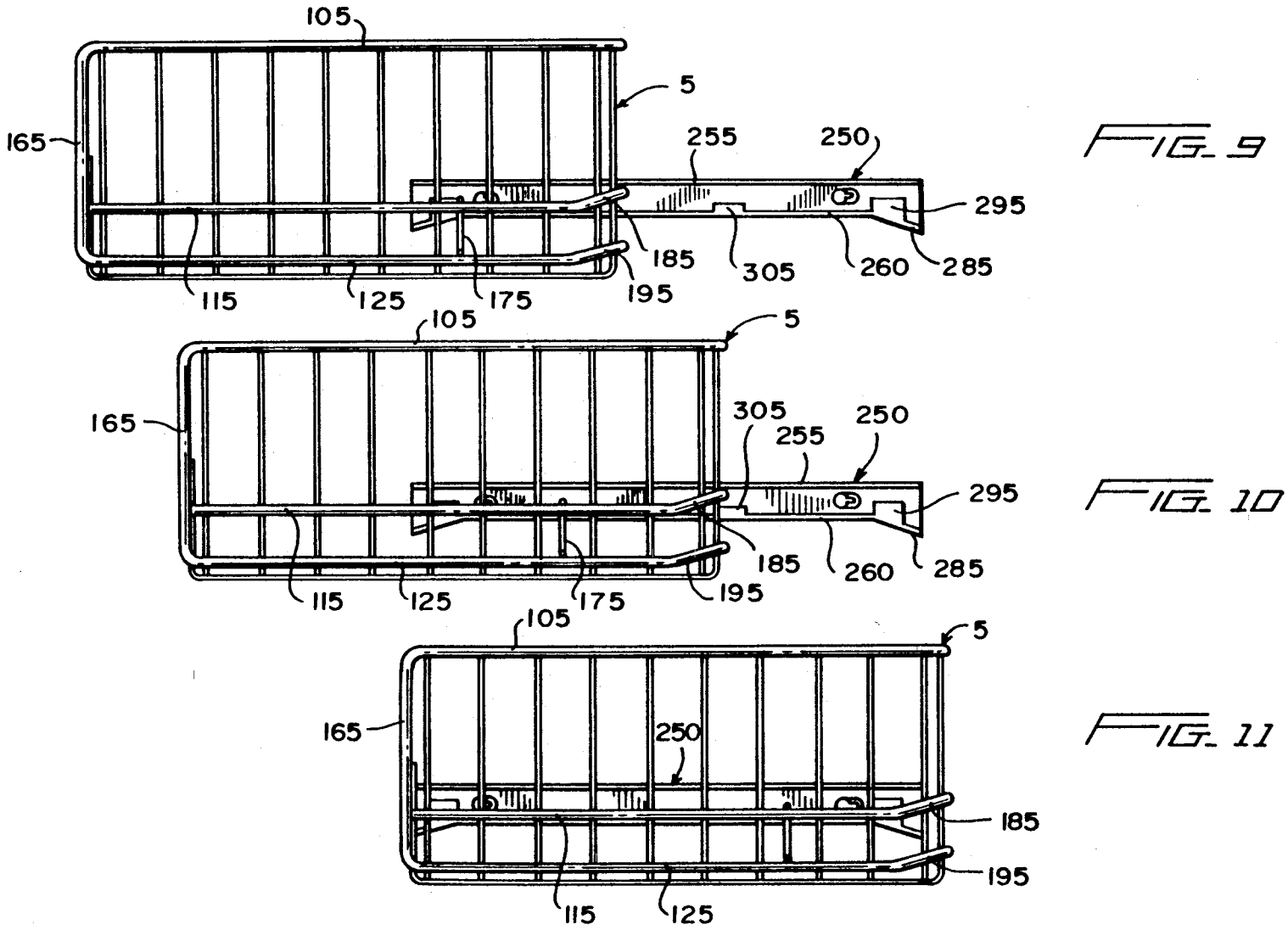
FIG. 9 depicts the basket shown in FIG. 1 mounted in an extended position upon the guide member of FIG. 5.
FIG. 10 is similar to that shown in FIG. 9 with the basket in a partially retracted position.
FIG. 11 is similar to FIGS. 9 and 10 but depicts the basket in a fully retracted position.

Reference will now be made to FIGS. 9–11 in describing the interrelationship between basket assembly 5 and guide member 250 so as to enable basket assembly 5 to be vertically adjustable and slidable within a storage compartment. As stated above, FIG. 9 depicts the basket in a fully extended position, FIG. 10 depicts the basket in a partially extended or retracted position and FIG. 11 depicts the basket in a fully retracted position. In these figures, only one guide member 250 is shown for purposes of clarity. However, it should be understood that another guide member 250 is utilized on the other side of basket assembly 5. For reasons of simplicity, a description of how support rail 110 is slidably mounted within the U-shaped sideways open channel defined by the single guide member 250 will be described.

Initially, guide member 250 will be secured to a sidewall of the storage compartment in the manner previously described above. Basket assembly 5 will then be positioned such that support rail 110 is aligned with the U-shaped channel of guide member 250. Initial insertion of support rail 110 into the U-shaped channel of guide member 250 requires upwardly sloping section 180 of support rail 110 to be slightly lifted above abutment flange 290. This is required even though upwardly sloping section 180 extends upwardly a distance greater than the height of abutment flange 290 relative to the upper horizontal surface 275 of base 260. As support rail 110 is placed into the U-shaped channel of guide member 250, stop member 170 will engage abutment flange 290 such that the basket assembly 5 must be lifted again until stop member 170 clears abutment flange 290. At this point, basket assembly 5 will be permitted to freely slide rearward with support rail 110 engaging upper surface 275 of base 260 either until the back of basket assembly 5 abuts the rear of the storage compartment or, preferably, vertical support member 160 abuts the front end of guide member 250. Support rail 110 will be laterally maintained between sidewall 265 and guide tabs 300, 305 of guide member 250. In addition, since upwardly sloping section 180 extends higher than abutment flange 295, when basket assembly 5 is moved toward its fully retracted position as shown in FIG. 11, connecting rail 145 will clear abutment flange 295.

Based on this description, it can readily be seen that basket assembly 5 can be easily mounted upon or removed from a pair of respective guide members 250 and can be adjustably mounted within a storage compartment by utilizing either the first pair of support rails 110 and 115 or the second pair of support rails 120 and 125. In addition, it should be noted that although only two pairs of support rails are provided in the embodiment described, additional support rails could also be provided to further increase the degree of vertical adjustability. However, two pairs of support rails were chosen for the preferred embodiment in order to maximize the storage area of basket assembly 5. Furthermore, it should be noted that since support rails 110, 115, 120 and 125 are located laterally outwardly of sidewall portions 15 and 20, interference with the sliding movement of basket assembly 5 upon guide members 250 by goods placed in the basket is prevented.

Reference will now be made to FIGS. 12–15 in describing a second basket embodiment, generally indicated at 370, according to the present invention. In general, the second basket embodiment shown in FIGS. 12–15 is different from the embodiment disclosed in FIGS. 1–4 in that the height of sidewalls 15, 20, front wall 25 and rear wall 30 have been increased in order to increase the capacity of the basket for storing larger goods. Due to the similarity in construction, the reference numerals utilized in the first embodiment which correspond to structure in the FIGS. 12–15 embodiment have been carried over to the latter figures and will not be redescribed herein. The embodiment of FIGS. 12–15 also differs from the FIGS. 1–4 embodiment in the construction of front wall 25. In the second embodiment, vertically extending connecting rails 160 and 165 are interconnected by an attaching member 375. Attaching member 375 includes a first horizontal section 380, a vertically extending section 385 and a second horizontal section 390. As is evident from viewing these figures, first horizontal section 380 is located vertically above second horizontal section 390 and enables taller articles to be placed in that portion of the basket without risk of the goods falling out the front of the basket. Additionally, the notched area in the front wall 25 of the second basket embodiment, as formed by attaching member 375, allows loading of large square or rectangular packages such as frozen pizzas without removing the basket 370 from the guide members 250. A protective cover 395, similar to cover 210, is provided over at least second horizontal portion 390. The basket assembly according to the second embodiment can be slidably mounted upon guide members 250 in the same manner previously described with reference to basket assembly 5.

Reference will now be made to FIGS. 16–19 in describing a third basket embodiment according to the present invention. The basket assembly in these figures is generally indicated at 400. In a manner similar to that described with respect to the first embodiment, the basket assembly 400 includes a plurality of laterally spaced and longitudinally extending rail members 410–414 which define a front wall portion 420, a bottom wall portion 425 and a rear wall portion 430. Basket assembly 400 further includes a plurality of longitudinally spaced and laterally extending rail members 440–449 which define opposing sidewalls 455 and 460 and criss-cross with laterally spaced rail members 410–414 in forming bottom wall portion 425. In this embodiment, bottom wall portion 425 includes a first substantially horizontal wall portion 470, an upwardly sloping wall portion 475 and a second substantially horizontal wall portion 480. Unlike the longitudinally spaced rail members 61–70 described with respect to the first and second basket embodiments, longitudinally spaced rail members 440–449 in this embodiment extend straight from base portion 425 for substantially the entire height of side portions 455 and 460, and terminate in laterally, outwardly extending portions 485.

Figure 16:
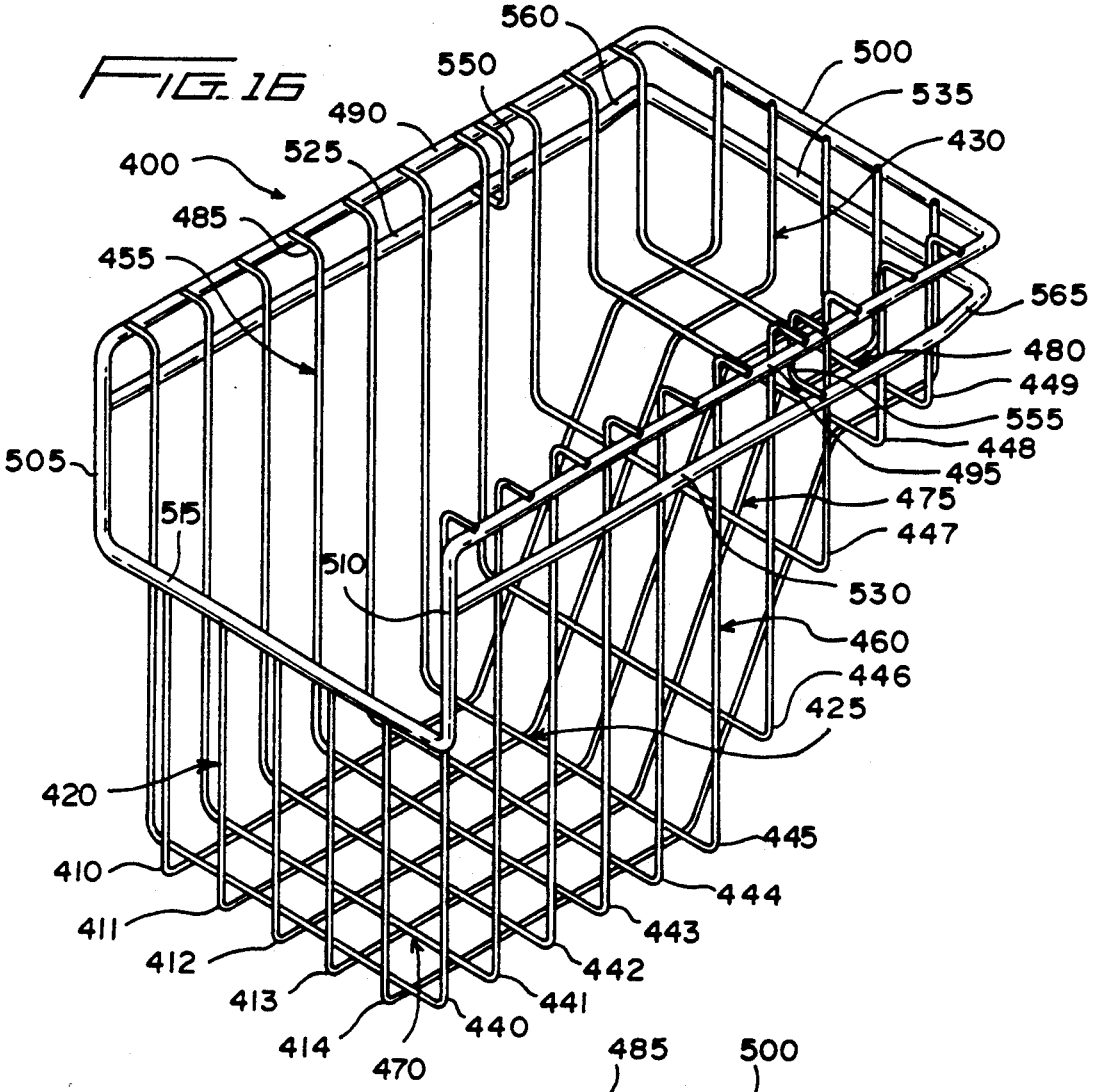
FIG. 16 is a perspective view of a basket and support assembly according to a third embodiment of the invention.
Figure 17:
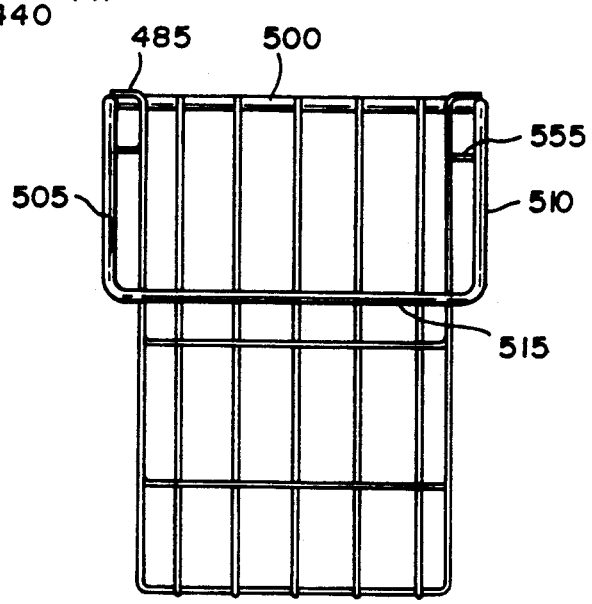
FIG. 17 is a front view of the basket depicted in FIG. 16.
Figure 19:
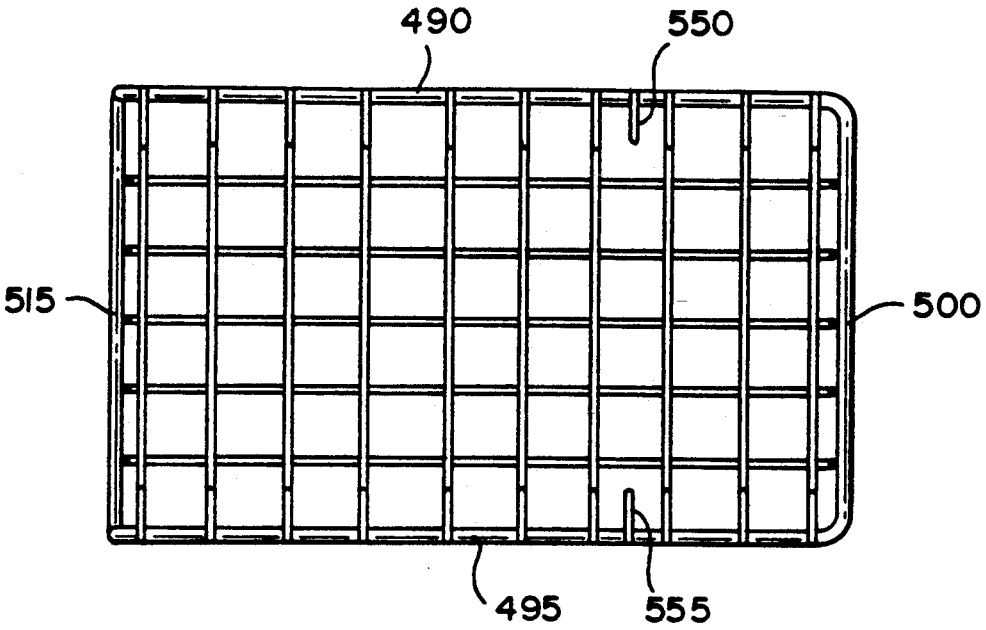
FIG. 19 is a top view of the basket depicted in FIG. 16.
Figure 18:
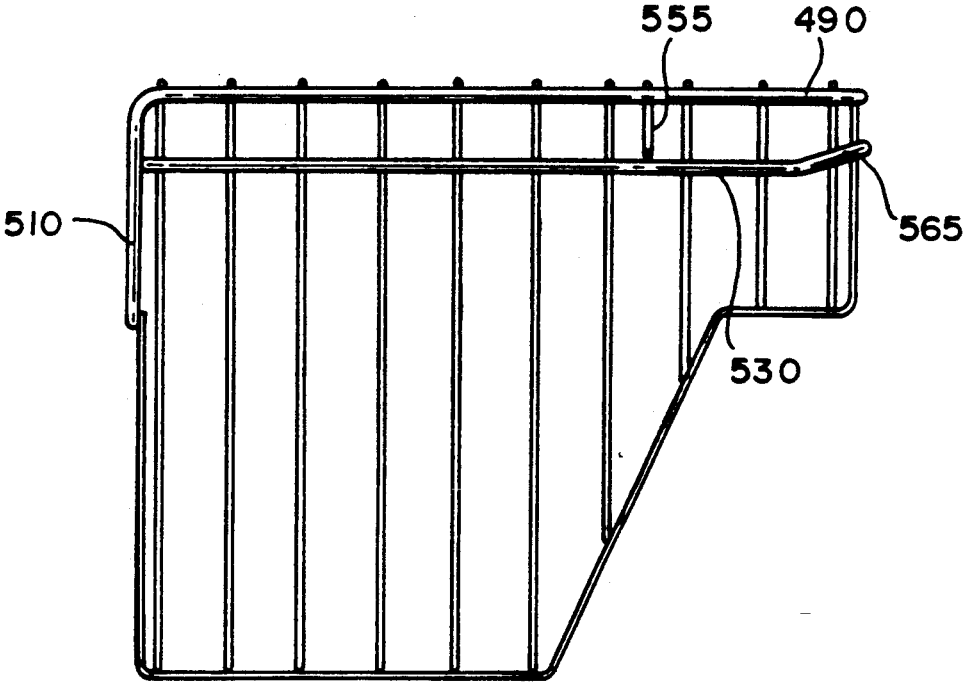
FIG. 18 is a side view of the basket depicted in FIG. 16.

Fixedly secured, such as by welding, to the ends of each of the laterally, outwardly extending portions 485 is a first pair of support rails 490, 495 which are located in a first, substantially horizontal plane below outwardly extending portions 485. Support rails 490 and 495 are interconnected adjacent rear wall portion 430 by a connecting rail 500 and by a pair of spaced vertically extending connecting rails 505 and 510, along with a horizontally extending connecting rail 515 at front wall portion 420. In a manner directly analogous to the connecting rails described with reference to the first basket embodiment of the invention, connecting rails 500 and 515 are also fixedly secured, preferably by welding, to the respective ends of the laterally spaced support rails 410–414 in order to provide additional structural rigidity to basket assembly 400. A second pair of support rails 525, 530 are located vertically below support rails 490 and 495, are interconnected by a rear connecting member 535 and are joined to vertical connecting rails 505 and 510, respectively. In addition, a pair of U-shaped stop members 550, 555 extend between and are fixedly secured to the upper surfaces of support rails 490, 525 and 495, 530, respectively. As best shown in FIGS. 16 and 18, support rails 525 and 530 include upwardly sloping rear portions 560, 565 in a manner directly analogous to upwardly sloping rear portion 180, 185, 190 and 195 in the previously described basket embodiments.

Figure 12:
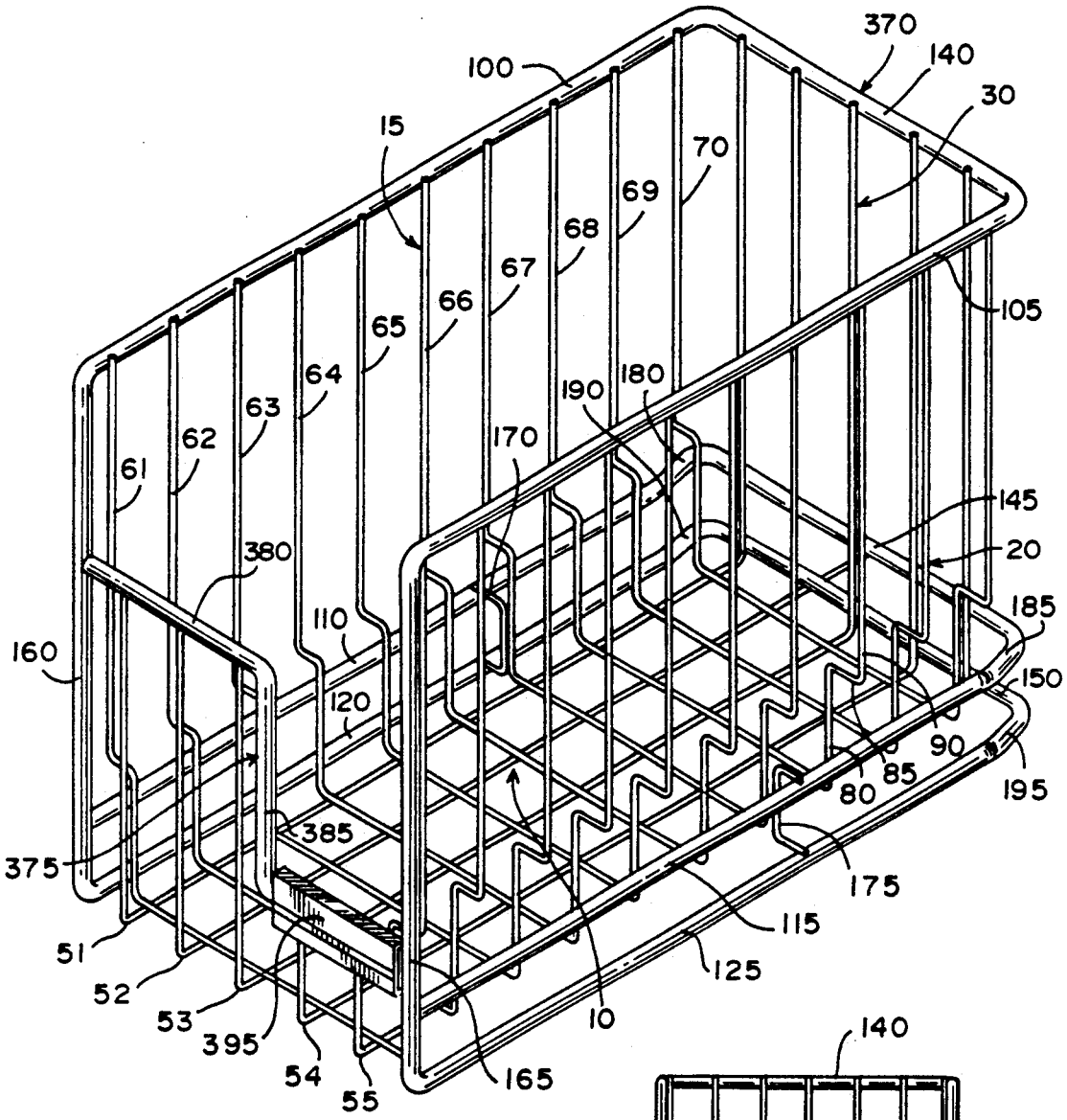
FIG. 12 is a perspective view of a basket and support arrangement according to a second embodiment of the invention.
Figure 13:
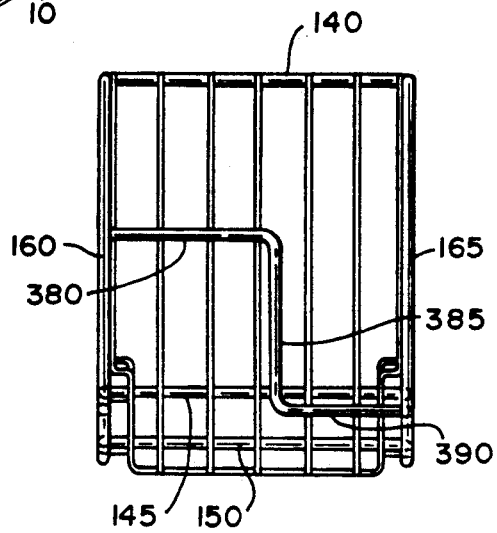
FIG. 13 is a front view of the basket depicted in FIG. 12.
Figure 15:
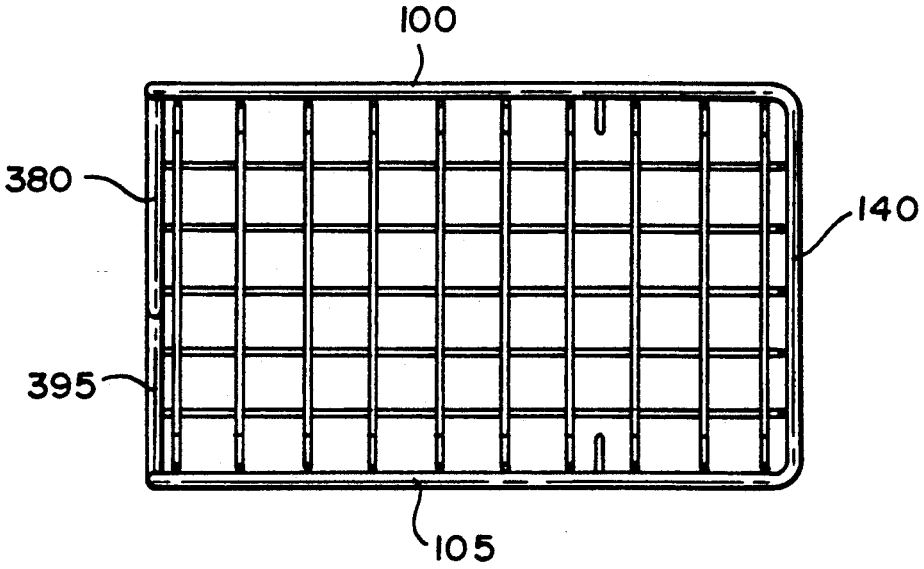
FIG. 15 is a top view of the basket depicted in FIG. 12.
Figure 14:
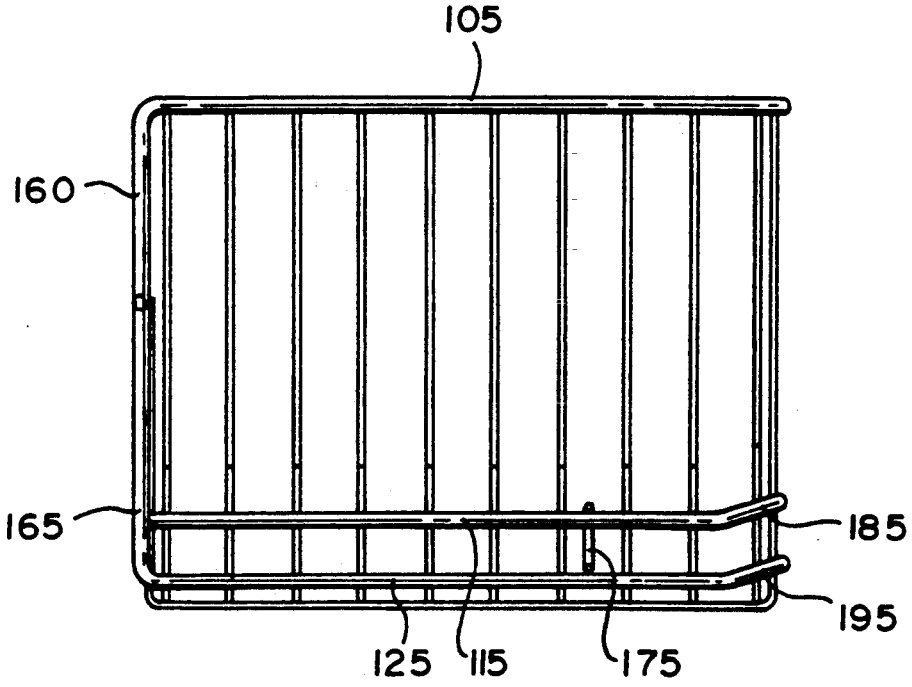
FIG. 14 is a side view of the basket depicted in FIG. 12.
Figure 21:
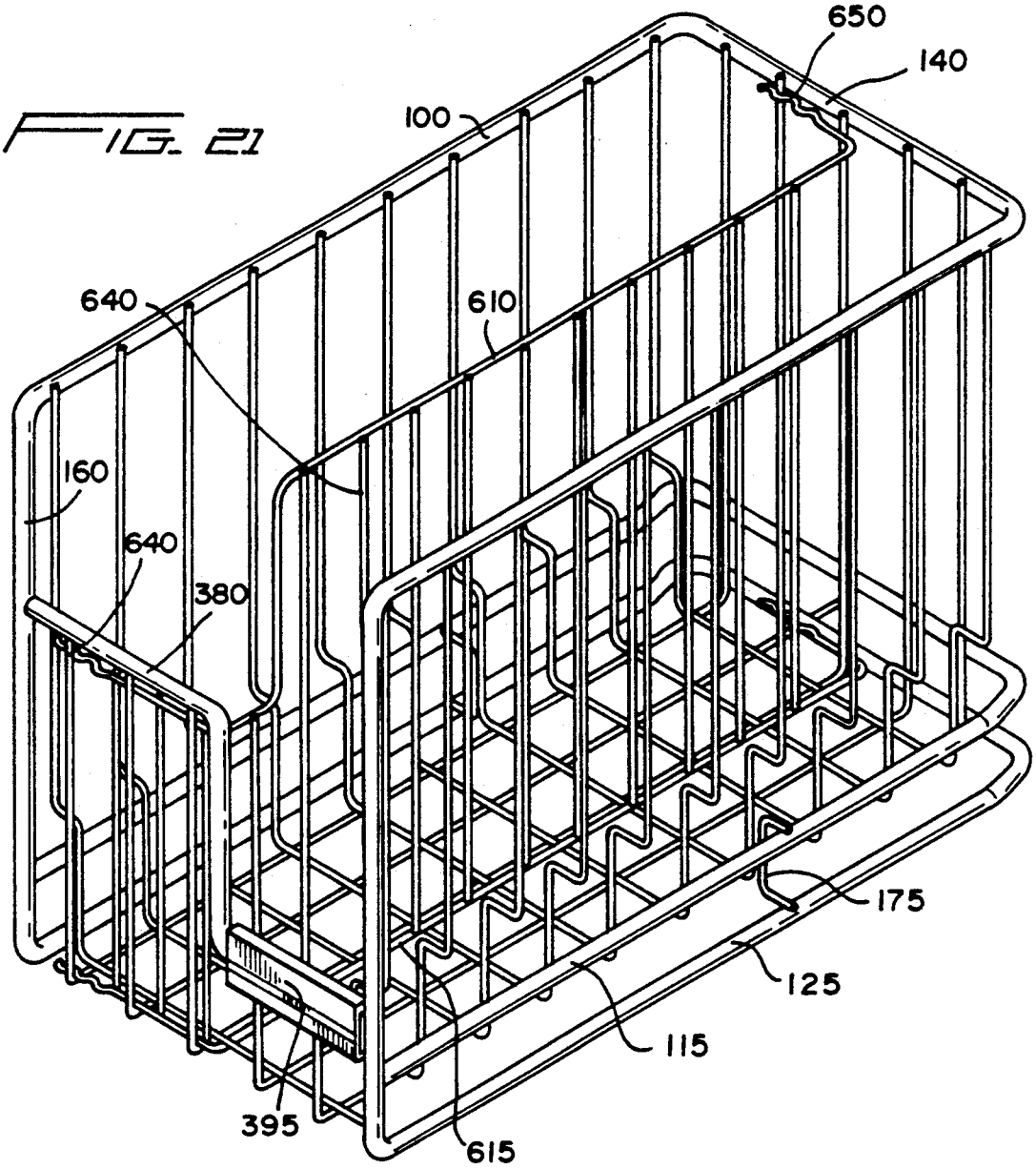
FIG. 21 is a perspective view of the basket shown in FIG. 12 with the divider of FIG. 20 mounted therein.
Figure 20:
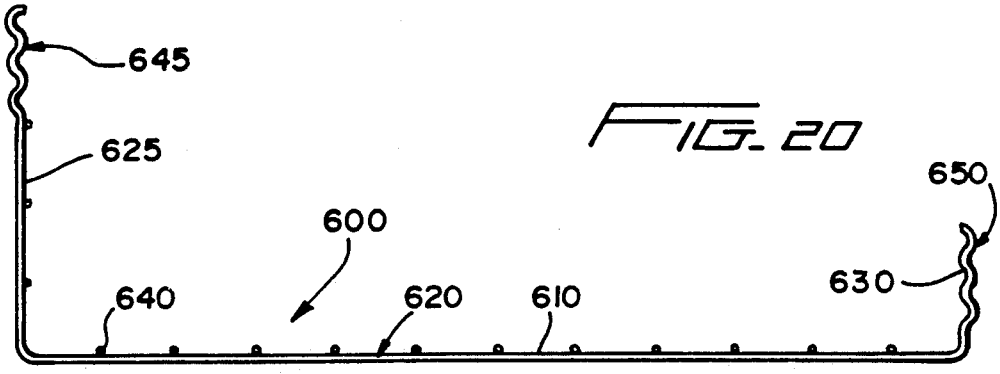
FIG. 20 depicts a divider unit for use with the baskets of the present invention.

FIG. 20 is a top view of a divider attachment for use with the basket assemblies of the present invention and FIG. 21 depicts the divider unit in a basket according to the FIG. 12 embodiment. The divider unit 600 is defined by upper and lower wire members 610, 615 each of which includes a main, longitudinal section 620 terminating in laterally extending sections 625 and 630. Upper and lower wire members 610 and 615 are interconnected by a plurality of vertically extending wire members 640. As best shown in the top view of FIG. 20, the ends of laterally extending portions 625 and 630 each include a wave-shaped section 645 and 650 respectively. Divider 600 is adapted to be mounted within the storage area of a basket with the adjacent wall defining rail members of the basket being engaged with the wave-shaped sections 645 and 650. As shown in FIG. 20, the crests of the wave-shaped sections 645 and 650 extend outward beyond the length of longitudinal member 620 such that when a divider 600 is formed of a length slightly less than the length of the storage area of the basket, wave-shaped sections 645 and 650 will be slightly spring biased against the basket walls to firmly maintain the divider in a desired position. Although such a divider 600 can be used with any shaped basket, it is particularly advantageous to utilize divider 600 with a deep-walled basket such that large goods, such as frozen pizzas or breads can be adequately retained in the basket in a convenient manner.

Figure 22:
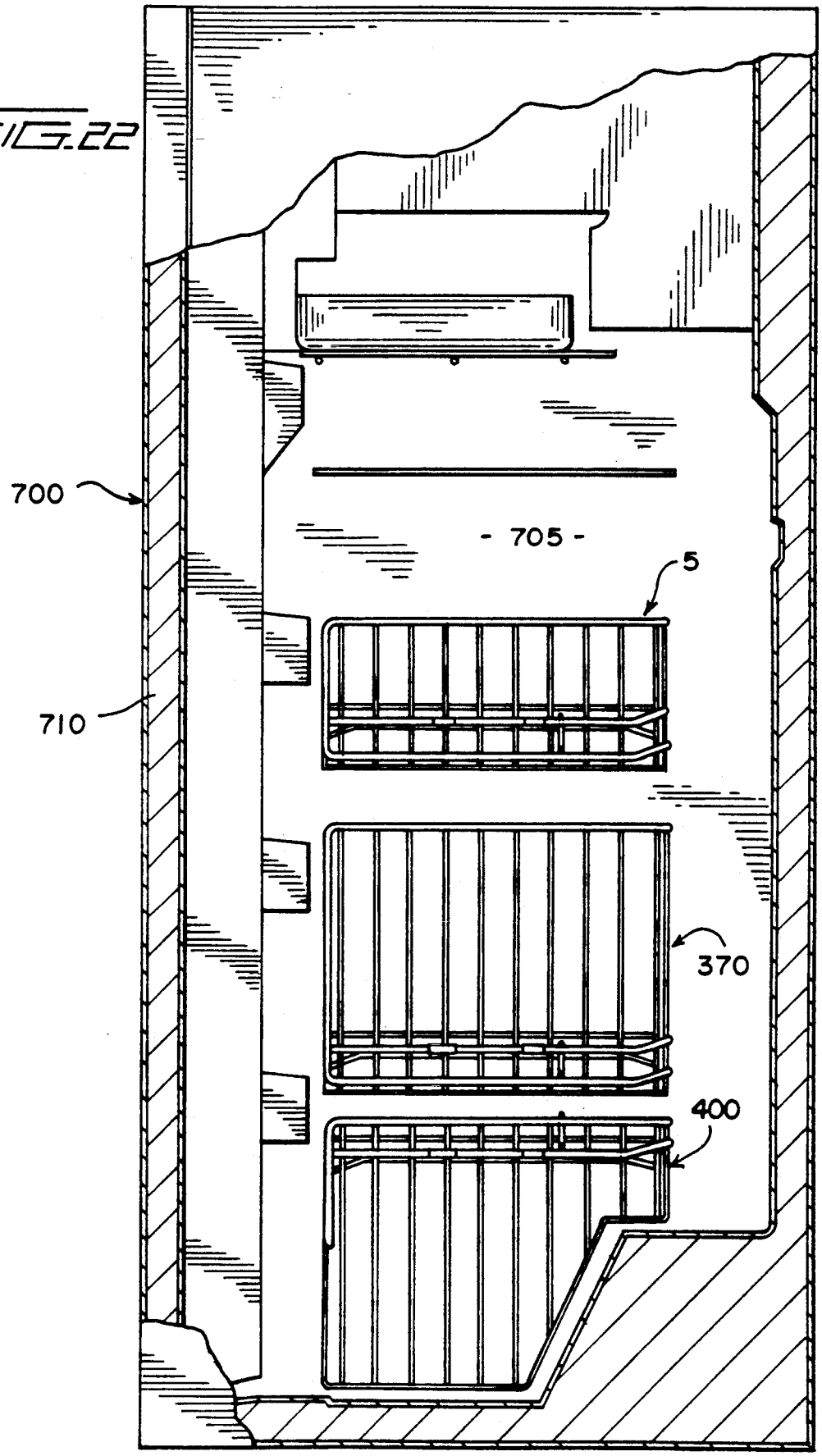
FIG. 22 is a cross-sectional view of a refrigerator/-freezer storage compartment which shows the embodiments of the basket according to the present invention mounted therein.

Finally, reference is made to FIG. 22 which shows a cross-sectional view of a freezer compartment of a front-opening refrigerator/freezer (generally indicated at 700) wherein the three embodiments of the basket assemblies disclosed herein are shown positioned within a freezer compartment 705, access to which is realized through opening a door 710. FIG. 22 is merely representative of possible arrangements for the particular basket assemblies disclosed as preferred embodiments of the present invention, however, it should be readily understood that the arrangement of these baskets may be altered or the types of baskets utilized in any given situation may vary. In general, it is to be understood that various changes and/or modifications may be made to the present invention without departing from the spirit or scope therein and that the invention is only intended to be limited by the scope of the following claims.

I claim:

1. A basket and mounting arrangement for an open front refrigerator storage compartment defined by top, bottom and opposite side walls, the arrangement comprising:

a) a pair of guide members for attachment to the opposite side walls of the storage compartment;

b) a basket including a bottom wall and means extending generally perpendicular to the bottom wall to form a front wall, a rear wall, and first and second side walls for defining a basket storage area;

c) first and second pairs of support members attached to the first and second side walls of the basket and extending substantially from the front to the rear of the basket, with the first and second pairs of support rails being vertically spaced one above the other for permitting the basket to be selectively mountable for sliding movement in a plurality of vertical positions by engaging either pair of support rails with the pair of guide members.

2. The basket and mounting arrangement of claim 1, further including a stop member associated with said support rails on at least one side of said basket and abutment means carried by at least one of said guide members, said stop member being engageable with said abutment means for limiting the sliding movement of said basket relative to said guide members.

3. The basket and mounting arrangement of claim 1, wherein at least one of said first and second pairs of support rails include upwardly sloping rear sections.

4. The basket and mounting arrangement of claim 3, further including a stop member extending between the support rails on at least one side of said basket and abutment means carried by at least one of said guide members, said stop member being engageable with said abutment means to limit the sliding movement of said basket relative to said guide members.

5. The basket and mounting arrangement of claim 4, wherein said abutment means comprises an upwardly extending flange member.

6. The basket and mounting arrangement of claim 5, wherein said upwardly sloping rear sections extend above a horizontal plane defined by its respective pair of support rails a distance greater than the vertical height of said flange member.

7. The basket and mounting arrangement of claim 6, wherein each of said guide members includes a longitudinally extending guide surface portion which slopes downwardly at its opposite ends.

8. The basket and mounting arrangement of claim 1, wherein said front wall extends upward from said bottom wall a distance less than said side walls.

9. The basket and mounting arrangement of claim 1, further comprising divider means including a main body section terminating in first and second connecting sections, said connecting sections being engageable with respective walls of said basket for dividing said basket into plural storage areas.

10. The basket and mounting arrangement of claim 9, wherein said first and second connecting sections are each of a wave-shaped configuration.

11. The basket and mounting arrangement of claim 1, further including a plurality of connecting rails which extend about said rear wall portion and interconnect respective pairs of said support rails.

12. The basket and mounting arrangement of claim 11, wherein each connecting rail is integrally formed with a respective pair of said support rails.

13. The basket and mounting arrangement of claim 1, wherein said front and rear walls are defined by a plurality of laterally spaced rail members that extend from said front wall longitudinally across said bottom wall, to said rear wall and said side walls are defined by a plurality of longitudinally spaced rail members that extend from said first side wall, laterally across said bottom wall, to said second side walls.

14. The basket and mounting arrangement of claim 1, wherein each of said walls is formed of a plurality of spaced wires.

15. The basket and mounting arrangement of claim 1, wherein said first and second side walls include lower sections that extend upwardly from said bottom wall for a first predetermined distance, central sections that extend laterally outwardly a second predetermined distance and upper sections that extend upwardly a third predetermined distance, said support rails being vertically disposed below said central sections.

16. The basket and mounting arrangement of claim 1, wherein said first pair of support rails and said second pair of support rails are generally parallel to each other and each pair includes upwardly sloping rear sections.

17. The basket and mounting arrangement of claim 1, wherein said front wall includes two sections which extend upward from said bottom wall by different distances.

18. The basket and mounting arrangement of claim 17, further comprising divider means including a main body section terminating in first and second connecting sections, said connecting sections being engageable with respective walls of said basket for dividing said basket into plural storage areas.

19. The basket and mounting arrangement of claim 1, wherein said first and second side walls include first sections that extend upwardly from said bottom wall for a first predetermined distance and second sections that extend laterally outwardly for a second predetermined distance, one of said first and second pairs of support rails being secured to said second sections at a distance laterally spaced from said first sections.

20. The basket and mounting arrangement of claim 19, wherein said bottom wall includes two longitudinally spaced, flat sections interconnected by a sloping section.

* * * * *